US010273714B2

(12) United States Patent
Kim

(10) Patent No.: US 10,273,714 B2
(45) Date of Patent: Apr. 30, 2019

(54) REPLACEMENT DOOR HANDLE

(71) Applicant: Duck Ho Kim, Namyangju-si (KR)

(72) Inventor: Duck Ho Kim, Namyangju-si (KR)

( * ) Notice: Subject to any disclaimer, the term of this patent is extended or adjusted under 35 U.S.C. 154(b) by 0 days.

(21) Appl. No.: 15/509,735

(22) PCT Filed: Jun. 18, 2015

(86) PCT No.: PCT/KR2015/006184

§ 371 (c)(1),
(2) Date: Mar. 8, 2017

(87) PCT Pub. No.: WO2016/039519

PCT Pub. Date: Mar. 17, 2016

(65) Prior Publication Data

US 2017/0260773 A1 Sep. 14, 2017

(30) Foreign Application Priority Data

Sep. 12, 2014 (KR) ..... 10-2014-0121371

(51) Int. Cl.
*E05B 1/04* (2006.01)
*E05B 1/00* (2006.01)
*E05B 63/00* (2006.01)

(52) U.S. Cl.
CPC ..... *E05B 1/04* (2013.01); *E05B 1/0061* (2013.01); *E05B 1/0069* (2013.01); *E05B 63/0056* (2013.01); *Y10T 16/458* (2015.01)

(58) Field of Classification Search
CPC ..... E05B 1/04; E05B 1/0061; E05B 1/0069; Y10T 16/458

(Continued)

(56) References Cited

U.S. PATENT DOCUMENTS 1,878,394 A * 9/1932 Haan, Jr. ..... E05B 1/00 16/412
2,349,055 A * 5/1944 Rhein ..... E05B 1/04 292/347

(Continued)

FOREIGN PATENT DOCUMENTS

DE 29708110 U1 * 7/1997 ..... E05B 1/00
KR 20-0165513 Y1 2/2000

(Continued)

OTHER PUBLICATIONS

WikiHow to Fix a Sagging Emtek Door Handle, wikiHow, Mar. 24, 2014, Extracted from: http://www.wikihow.com/Fix-a-Sagging-Emtek-Door-Handle.

*Primary Examiner* — Marcus Menezes
(74) *Attorney, Agent, or Firm* — Novick, Kim & Lee, PLLC; Jae Youn Kim

(57) ABSTRACT

The present invention relates to a replacement door handle, and comprises: a connection member which has a groove with a certain depth formed therein so as to be coupled to a door lock; and a handle body which has a corresponding fitting portion formed therein so that the connection member can be fitted into and coupled to the fitting portion. Thereby, the present invention has the following effects: it is possible to replace or change a door handle, which is coupled to a door lock, with or to a variety of designs; it is possible to replace or change the door handle in a convenient and easy manner; and it is possible to use the door handle according to a user's preference or taste.

3 Claims, 6 Drawing Sheets

(58) Field of Classification Search
USPC ..... 16/412
See application file for complete search history.

(56) References Cited

U.S. PATENT DOCUMENTS

| | | | | | |
|---|---|---|---|---|---|
| 2,433,993 | A * | 1/1948 | Jakeway | A47B 95/02 | 292/347 |
| 2,567,565 | A * | 9/1951 | Keeler | E05B 1/04 | 16/110.1 |
| 3,400,446 | A * | 9/1968 | Yulkowski | E05B 1/04 | 228/175 |
| 4,597,600 | A * | 7/1986 | Wilke | E05B 3/06 | 292/336.3 |
| 4,921,289 | A * | 5/1990 | Shen | E05B 55/005 | 292/336.3 |
| 5,228,798 | A * | 7/1993 | Tzanovici | E05B 1/0015 | 292/350 |
| 5,231,731 | A * | 8/1993 | Jones, Jr. | E05B 1/0053 | 16/412 |
| 5,265,924 | A * | 11/1993 | Kim | E05B 3/065 | 292/336.3 |
| 5,364,139 | A * | 11/1994 | Bergen | E05B 13/004 | 292/169 |
| 5,551,323 | A * | 9/1996 | Beere | B25G 1/105 | 16/430 |
| 5,639,132 | A * | 6/1997 | Wartian | E05B 1/00 | 292/347 |
| 5,713,614 | A * | 2/1998 | Anderson | E05B 1/0053 | 16/413 |
| 9,447,610 | B2 * | 9/2016 | Ou | E05B 63/006 | |
| 2003/0033690 | A1 * | 2/2003 | Lin | E05B 1/003 | 16/412 |
| 2006/0230576 | A1 * | 10/2006 | Meine | A47K 17/00 | 16/110.1 |
| 2007/0007778 | A1 * | 1/2007 | Gomes | E05B 1/0053 | 292/336.3 |
| 2008/0030030 | A1 * | 2/2008 | Huang | E05B 1/06 | 292/348 |
| 2010/0281781 | A1 * | 11/2010 | Badgley | B25G 1/10 | 49/460 |

FOREIGN PATENT DOCUMENTS

| | | | | |
|---|---|---|---|---|
| KR | 20-0165514 Y1 | | 2/2000 | |
| KR | 200288634 | * | 8/2002 | E05B 3/02 |
| KR | 20-0288634 Y1 | | 9/2002 | |
| KR | 20-0295133 Y1 | | 11/2002 | |
| KR | 10-0836579 B1 | | 6/2008 | |
| KR | 10-1408400 B1 | | 6/2014 | |

* cited by examiner

REPLACEMENT DOOR HANDLE

TECHNICAL FIELD

The present invention relates to a replacement door handle, and more particularly, to a replacement door handle in which the door handle having a variety of forms or shapes is replaced in a convenient manner, selected from a variety of options according to a user's taste or preference, easy to manufacture, and can be easily installed.

BACKGROUND ART

In general, doors of a home or office are provided with door handles on the inner and outer sides of the door so that a user can easily open and close the door. The door handle is connected to a door locking device so that the door can be opened when the user rotates the door handle. The door handle is mostly shaped in a bar or sphere, and mostly made of a metal in consideration of durability.

These doors are provided with a door lock so as to be convenient for opening and closing the door while keeping the door closed, and it is classified into a knob type and a lever type according to the shape of the handle that can be held by a hand to open and close the door.

The knob-type door handle is advantageous in that the handle is formed in a spherical shape so that the outer appearance of the handle is neat and an object is not caught in the handle. However, it is difficult for the hand-impaired person or children to rotate the knob-type handle.

Therefore, recently, the use of a lever-type door handle has been rapidly increasing, for example, the installation of the lever-type handle is legally required for the convenience of impaired people.

The lever-type door handle can move a latch bolt that keeps the door closed, by simply pushing a lever, which protrudes in a lateral direction, downwards or upwards, so that the impaired person or children can easily open the door.

Such a door handle is installed during the construction of a building, so that the user may not replace or change the door handle as necessary, and the door handle once selected during the construction may not be replaced, so that the construction quality satisfaction of a building owner can be decreased.

In addition, even if the user works interior decoration for an indoor environment, the door has to be replaced or changed, so that the cost for replacing or changing the door may be excessive. Moreover, when the door handle is to be replaced or changed, the entire door lock has to be replaced or changed, so that many work processes due to the replacement or change are required, and the entire door handle has to be changed.

In addition, the door handle is usually formed in a very simple shape, so that the user's satisfaction with respect to the door handle is decreased. In this regard, door handles having various forms or shapes according to the user's preference or taste are manufactured.

For example, patent document 1 (KR10-0836579) discloses a straight door handle cover.

The straight door handle cover according to the following patent document 1 (KR10-0836579)is a straight door handle cover capable of relieving the sliding and the impact, which is produced of one selected from silicone, rubber, polyurethane, synthetic resin, and an elastomeric material having elasticity, flexibility, and a non-slip property. The straight door handle cover includes a body portion having a space for receiving a straight door handle and fastened with the door handle so as to make contact with a hand of a user, an insertion gap formed at the body portion in an elongate shape in a longitudinal direction of the body portion so as to allow the door handle to be easily inserted into the body portion, and a protruding portion protruding in the longitudinal direction of the body portion to cover a rotary shaft of the handle and prevent the straight handle cover from being rotated.

Patent document 2 (KR10-1408400)discloses a door handle.

The door handle according to following patent document 2 (KR10-1408400) includes a holder coupled to a fastening hole formed in a door by fastening unit, and a handle cut according to a distance between holders and coupled to the holder, wherein the holder includes a holder body coupled to the door for coupling the handle, and a holder cover coupled to the holder body.

In addition, there are disclosed a latching groove formed in the holder body in a position where the holder body makes close contact with the door, a latching protrusion formed in the holder cover so as to be slidably coupled to the latching groove, a handle retention body protruding from a finishing plate formed at an end portion of the holder body in a position where the holder body is coupled to the handle so as to be coupled to an inner diameter of the handle, a finishing ring interposed between the handle and the holder to compensate for a step difference caused by the coupling, and a locking unit for locking and releasing the holder body and the holder cover at a position of the handle retention body.

DISCLOSURE

Technical Problem

However, the door handle according to the related art may not be easily replaced or changed, the door handle according to the user's preference or taste may not be used, and the entire door handle has to be replaced or changed when replacing or changing the door handle.

In addition, it takes a long time for the replacement or change work of the door handle, costs for the replacement or change of the door handle are incurred, costs for a mold are excessive when the door handle is manufactured in various forms or shapes, and the manufacture or installation of the door handle causes inconvenience and costs.

An object of the present invention is to solve the problems as described above, that is, to provide a replacement door handle which is replaceably provided to satisfy the user's preference or taste with various materials, forms or shapes.

Another object of the present invention is to provide a replacement door handle, which can be easily replaced or changed, to a door lock.

Still another object of the present invention is to provide a replacement door handle capable of replacing or changing a handle body and a connection portion coupled to the door lock.

Technical Solution

To achieve the objects described above, according to the present invention, there is provided a replacement door handle including a connection member which has a groove with a certain depth formed therein so as to be coupled to a door lock, and a handle body which has a corresponding fitting portion formed therein so that the connection member can be fitted into and coupled to the fitting portion.

The connection member may include a first connection portion having a predetermined length and having the groove, and a second connection portion integrally provided with the first connection portion and extending from the first connection portion so as to be coupled to the fitting portion.

The connection member may include a first hole formed in the first connection portion for fixing the connection member to the door lock, and a fixing unit coupled to the first hole.

The handle body may include a plurality of fixing holes for fixing the handle body to the connection member, and the connection member may include a second hole corresponding to the fixing hole of the handle body.

The handle body may be separably coupled by the fixing unit so as to be bonded or replaced in a state that the second connection portion is fitted into the fitting portion.

Advantageous Effects

As described above, according to the replacement door handle of the present invention, the door handle coupled to the door lock can be replaced or changed in various designs, the door handle can be conveniently and easily replaced or changed, and the door handle according to the user's preference or taste can be used.

According to the replacement door handle of the present invention, the connection member and the door handle coupled to the door lock can be coupled or fixed in various manners, the door handle can be molded or manufactured with various materials, and the door handle can be molded or manufactured in various designs regardless of the connection member.

In addition, the connection member can be produced by only one mold, so that the cost for manufacturing the mold can be remarkably reduced, and a cover or a door-protection member is not installed on the connection member during the installation of the door, so that the construction time can be reduced. Moreover, it is possible to satisfy the user's taste or preference and to achieve easiness in manufacture of the door handle and easiness in construction, and the user can manipulate deformable materials such as wood and the like into a desired shape.

BEST MODE

Mode for Invention

Hereinafter, a replacement door handle according to preferred embodiments of the present invention will be described in detail with reference to the accompanying drawings.

Figure 1:
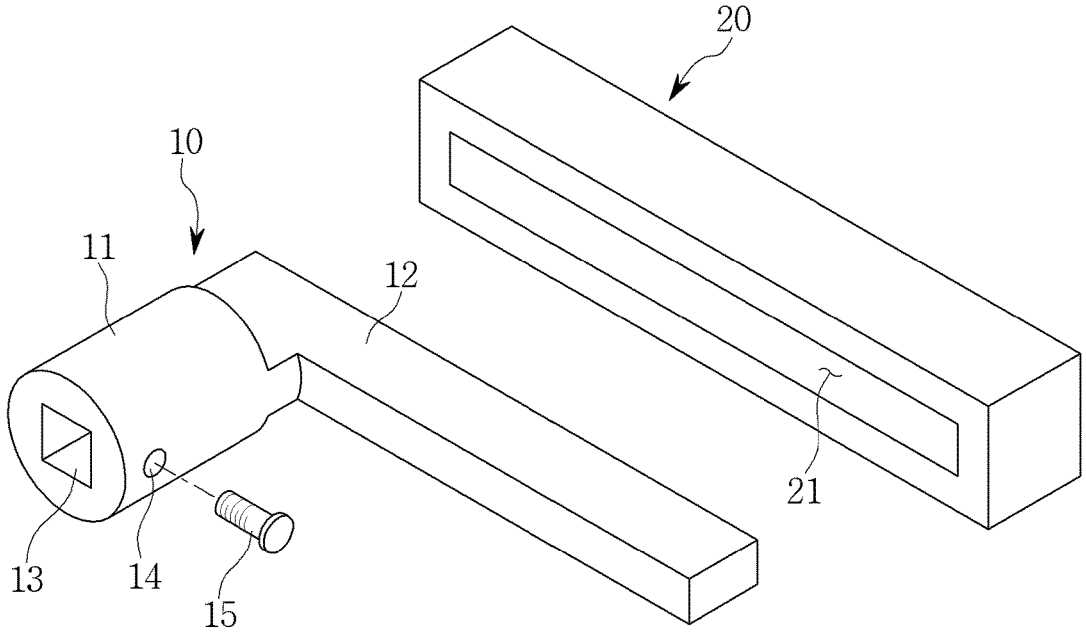
FIG. 1 is an exploded perspective view showing a door handle according to a first preferred embodiment of the present invention.
Figure 2:
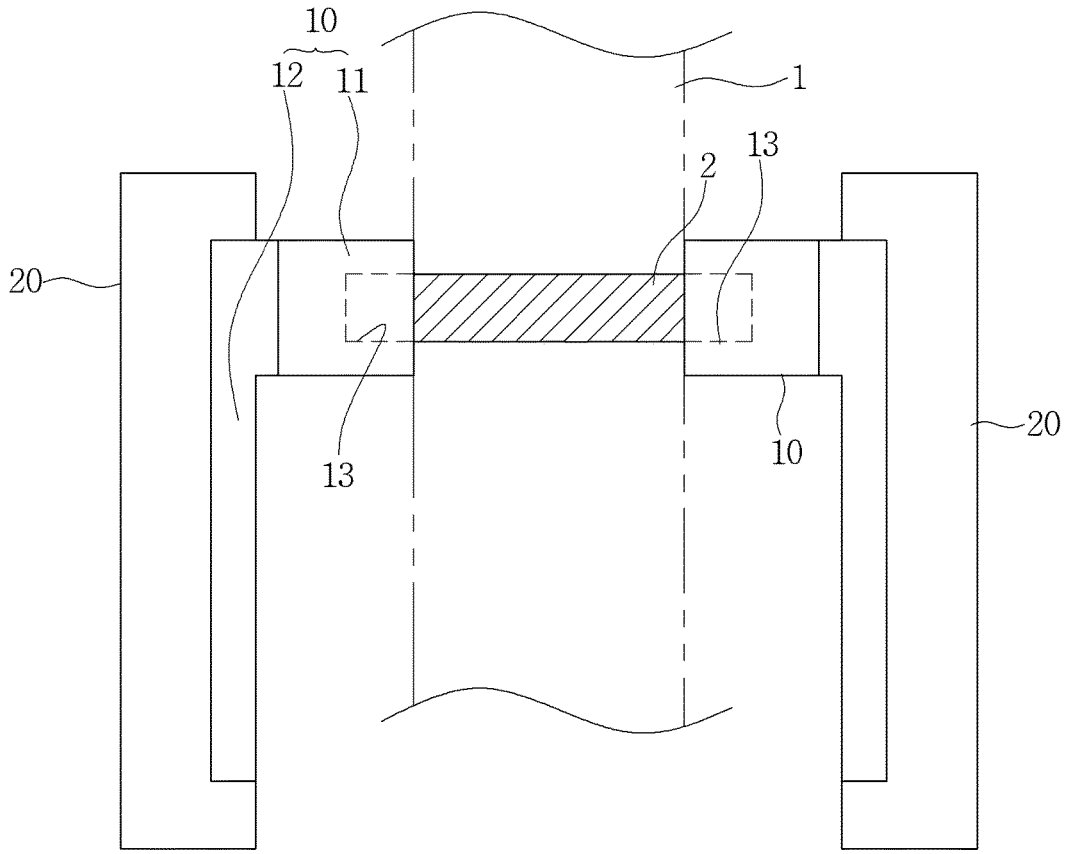
FIG. 2 is a sectional view showing the door handle according to the first preferred embodiment of the present invention in a state that the door handle is coupled to a door lock.

FIG. 1 is an exploded perspective view showing a door handle according to a first preferred embodiment of the present invention, and FIG. 2 is a sectional view showing the door handle according to the first preferred embodiment of the present invention in a state that the door handle is coupled to a door lock.

According to preferred embodiments of the present invention, there is provided a replacement door handle including a connection member 10 which has a groove 13 with a certain depth formed therein so as to be coupled to a door lock, and a handle body 20 which has a corresponding fitting portion 21 formed therein so that the connection member 10 can be fitted into and coupled to the fitting portion 21.

As shown in FIGS. 1 and 2, the door handle according to the first embodiment of the present invention includes a connection member 10 fixedly coupled to a door lock, and a handle body 20 replaceably installed in the connection member 10.

The door lock (not shown) changes a door 1 into a locked state, or an unlocked state that the door 1 can be opened and closed. In an ordinary door lock, door handles can be provided on both surfaces of the door 1.

As shown in FIG. 2, the door lock includes a locking bar 2 having a predetermined length to pass through the door 1, and the door handles can be installed at both ends of the locking bar 2, respectively.

An ordinary door lock having the locking bar 15 as described above is used, thus a detailed description for the door lock will be omitted.

The door handle according to the present invention may include a connection member 10 coupled to a locking bar 2, and a handle body 20 coupled to the connection member 10, wherein the handle body 20 may be formed in various forms or shapes so as to be selected according to the user's preference and taste.

The connection member 10 may have a first connection portion 11 having a predetermined length, and a second connection portion 12 integrally provided with the first connection portion 11 and having a predetermined length in a direction crossing the first connection portion 11.

The first connection portion 11 may be provided with a groove 13 into which the locking bar 2 is inserted and coupled, and the groove 13 may be formed in various shapes such as a circle, a rectangle, a polygon, and the like according to the shape of the locking bar 2.

In addition, the first connection portion 11 may be formed with a first hole 14 where a fixing unit 15 is fastened such that the first connection portion 11 can be fixed to the locking bar 2. The fixing unit 15 may include a bolt fastened to the first hole 14 of the first connection portion 11 while being fastened to the locking bar 2, or a pin press-fitted to the first connection portion 11 and the locking bar 2.

The connection member 10 can be manufactured by only one mold, and has a function for opening and closing the door 1 while being installed in the locking bar 2 during construction.

In addition, the handle body 20 may be formed of a material such as wood, metal, stone, porcelain, plastic, synthetic resin, paper and the like, or may be formed of a material obtained by mixing at least two above-mentioned materials. Moreover, the handle body 20 may be formed of materials which can be freely molded or manufactured in various forms or shapes.

In other words, the handle body 20 may be manufactured by utilizing various materials having a form or shape desired by the user, as well as materials which can be modified in various designs.

The handle body 20 may be provided at one surface thereof with a fitting portion 21 corresponding to the second connection portion 12. The fitting portion 21 is formed such that the second connection portion 12 can be press-fitted into the fitting portion 21, or can be loosely fitted into the fitting portion 21 so that the second connection portion 12 can be freely attached and detached.

Meanwhile, a design of various forms or shapes can be applied to an outer side of the handle body 20, that is, an outer surface of the handle body 20 on which the fitting portion 21 is not formed. In other words, various designs desired by the user according to the preferences or taste can be applied to all surfaces of the handle body 20 except where the fitting portion 21 is formed.

Figure 3:
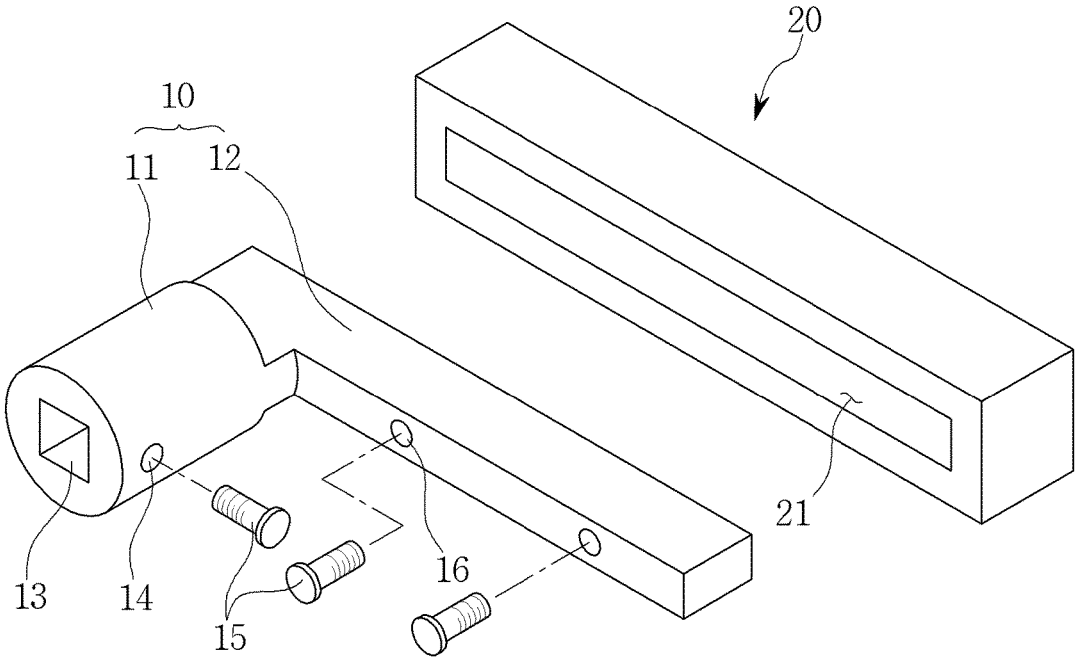
FIG. 3 is an exploded perspective view showing a door handle according to a second preferred embodiment of the present invention.
Figure 4:
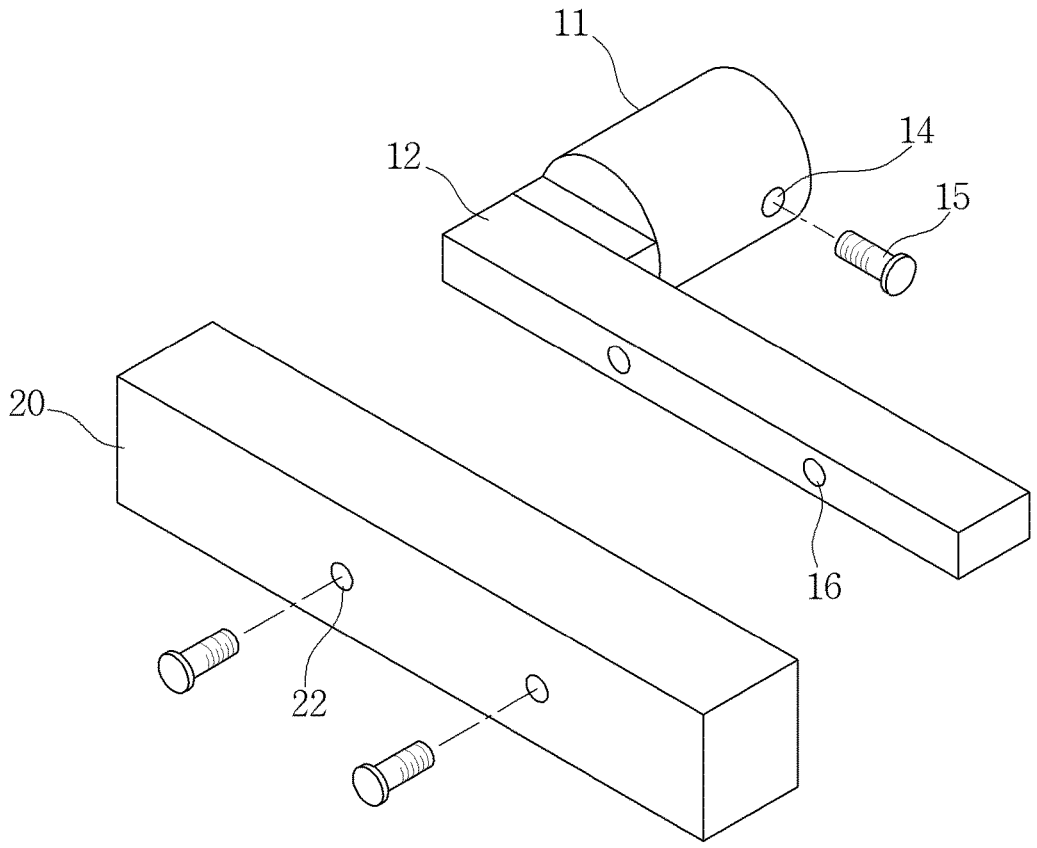
FIG. 4 is an exploded perspective view showing a door handle according to a third preferred embodiment of the present invention.

FIG. 3 is an exploded perspective view showing a door handle according to a second preferred embodiment of the present invention, and FIG. 4 is an exploded perspective view showing a door handle according to a third preferred embodiment of the present invention.

As shown in FIG. 3, the door handle according to the second embodiment of the present invention includes a connection member 10 coupled to a locking bar 2 of a door lock, and a handle body 20 coupled to the connection member 10.

The connection member 10 may include a first connection portion 11 having a predetermined length, and a second connection portion 12 integrally provided with the first connection portion 11 and extending in a direction crossing the first connection portion 12. The first connection portion 11 may be provided with a groove 13 into which the locking bar 2 is inserted and coupled, and the first connection portion 11 may be formed with a first hole 14 such that a fixing unit 15 can be coupled to the locking bar 2.

Meanwhile, the locking bar 2 may be press-fitted to the groove 13, and the groove 13 can be fixed by the fixing unit 15 after the groove is coupled to the locking bar 2.

In addition, a plurality of second holes 16 may be formed in the second connection portion 12 so that the handle body 20 can be coupled to the second connection portion 12.

The second hole 16 disposed in the second connection portion 12 and a fixing hole 22 disposed in the handle body 20 are formed at a corresponding position.

As shown in FIG. 3, the second hole 16 is formed in the second connection portion 12 of the connection member 10, and the fixing hole 22 (see FIG. 4) may be formed in the handle body 20 at a position corresponding to the second hole 16.

In addition, as shown in FIG. 4, the fixing hole 22 is formed in the handle body 20, and the second hole 16 corresponding to the fixing hole 22 is formed in the second connection portion 12.

The connection member 10 and the handle body 20 can be integrally coupled with each other by a bolt which is the fixing unit 15, or can be integrally coupled with each other by a fixing pin and the like.

In other words, the fixing unit 15 shown in FIG. 3 is fixed to the handle body 20 while passing through the second connection portion 12, and the fixing unit 15 shown in FIG. 4 is fixed to the second connection portion 12 while passing through the handle body 20, so that the connection member 10 can be integrally coupled to the handle body 20.

In the door handle according to the first to third embodiments of the present invention, the connection member 10 coupled to the door lock 2 can be manufactured by using one mold, and the handle body 20 can be molded or manufactured in various designs desired by the user according to the preference or taste depending on the material of the handle body 20.

Therefore, one mold is sufficient for manufacturing the connection member 10, so that the cost for manufacturing the mold can be reduced.

The coupling relation of the replacement door handle according to preferred embodiments of the present invention will be described in detail as follows.

As shown in FIGS. 1 and 2, the door handle according to the first embodiment of the present invention may include a connection member 10 coupled to the locking bar 2 of the door 1, and the handle body 20 coupled to the connection member 10.

The connection member 10 may include a first connection portion 11 having a predetermined length so as to be couple to the locking bar 2, and a second connection portion 12 integrally provided with the first connection portion 11 and extending from the first connection portion 12.

The first connection portion 11 may be provided with a groove 13 having a predetermined depth so that the locking bar 2 is inserted in and coupled to the groove 13, and the groove 13 may be provided with a first hole 14 coupled to a fixing unit 15.

The fixing unit 15 may include a bolt, a fixing pin, and the like, which can be fastened, or press-fitted.

In addition, the handle body 20 may be formed in various forms or shapes desired by the user, and formed of a material such as wood, metal, stone, porcelain, plastic, synthetic resin, paper and the like. The handle body 20 may have a form or shape in various designs according to the user's preference or taste.

The fitting portion 21 may be formed in the handle body 20 such that the fitting portion 21 corresponds to the second connection portion 12. The second connection portion 12 of the connection member 10 may be press-fitted to the fitting portion 21.

In addition, as in the second and third embodiments, the coupling can be made by a fixing unit 15 such as a bolt, a fixing pin, and the like, and the second connection portion 12 may be bonded to the fitting portion 21 as an adhesive or silicone is cured in a state that the second connection portion 12 is fitted into the fitting portion 21.

As shown in FIGS. 3 and 4, the door handle according to the second or third embodiment of the present invention may include a connection member 10 including a first connection portion 11 having a groove 13, and a second connection portion 12, and a handle body 20 replaceably coupled to the connection member 10.

The first connection portion 11 of the connection member 10 may be provided with the groove 13 coupled to the locking bar 2, and the second connection portion 12 may be formed with a second hole 16 that allows the handle body 20 to be coupled to the second connection portion 12.

In addition, a fitting portion 21 corresponding to the second connection portion 12 may be formed in the handle body 20, and a fixing hole 22 corresponding to the second hole 16 may be formed in the fitting portion 21.

The second hole 16 of the second connection portion 12 is located in match with the fixing hole 22 of the handle body 20 such that the second connection portion 12 and the handle body 20 can be firmly coupled to each other by the fixing unit 15.

On the other hand, a door lock is installed in the door 1 installed during the construction of the building, while a door handle necessary for operating the door lock is installed. At this time, in order to prevent scratches generated on the connection member or to prevent dust from being accumulated on the connection member, the connection member 10 is provided with a cover formed of fabric, Styrofoam and the like, or with a door-protection member.

Since the handle body 20 is coupled to the connection member 10 installed in the door lock during the construction of the building, an additional cover or door-protection member is unnecessary to be installed. Thus, the installation or construction work for the door handle is simply and easily performed.

A method of operating the replacement door handle according to preferred embodiments of the present invention will be described in detail with reference to FIGS. 1 to 6 as follows.

Figure 5:
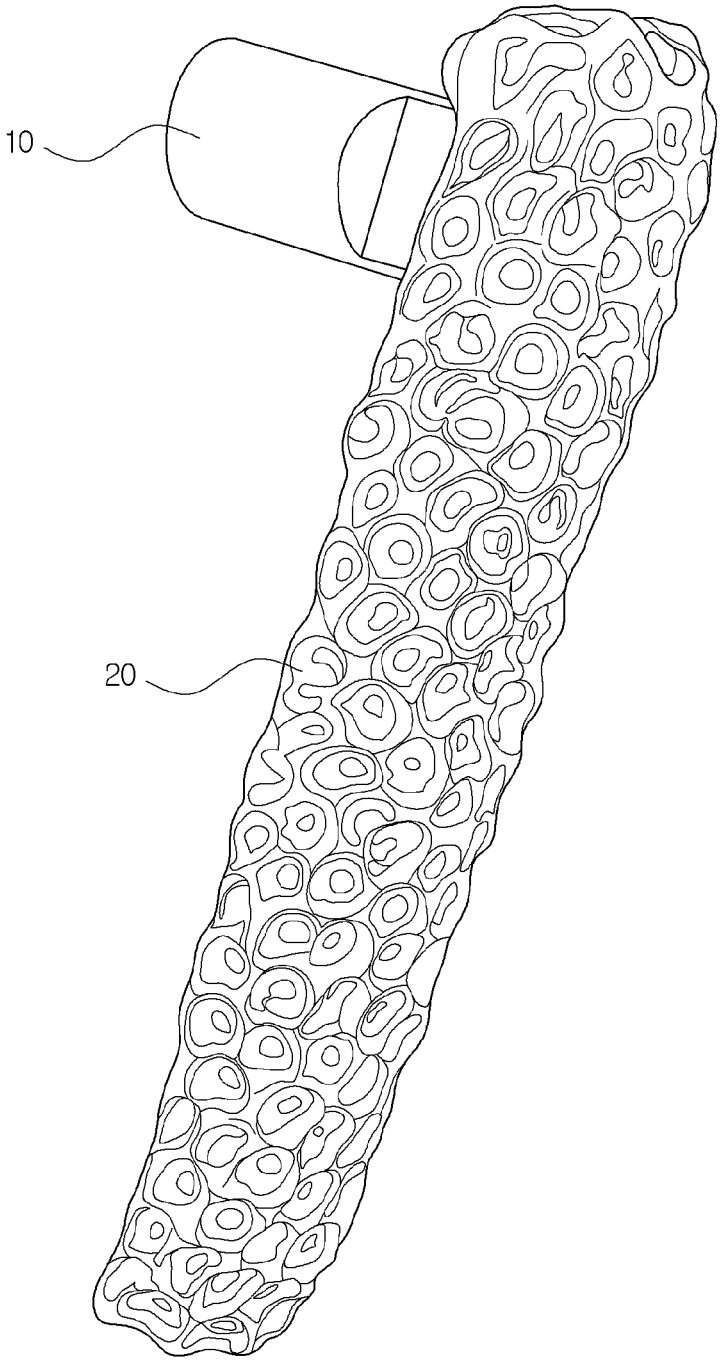
FIG. 5 is a photograph showing a door handle according to preferred embodiments of the present invention.
Figure 6:
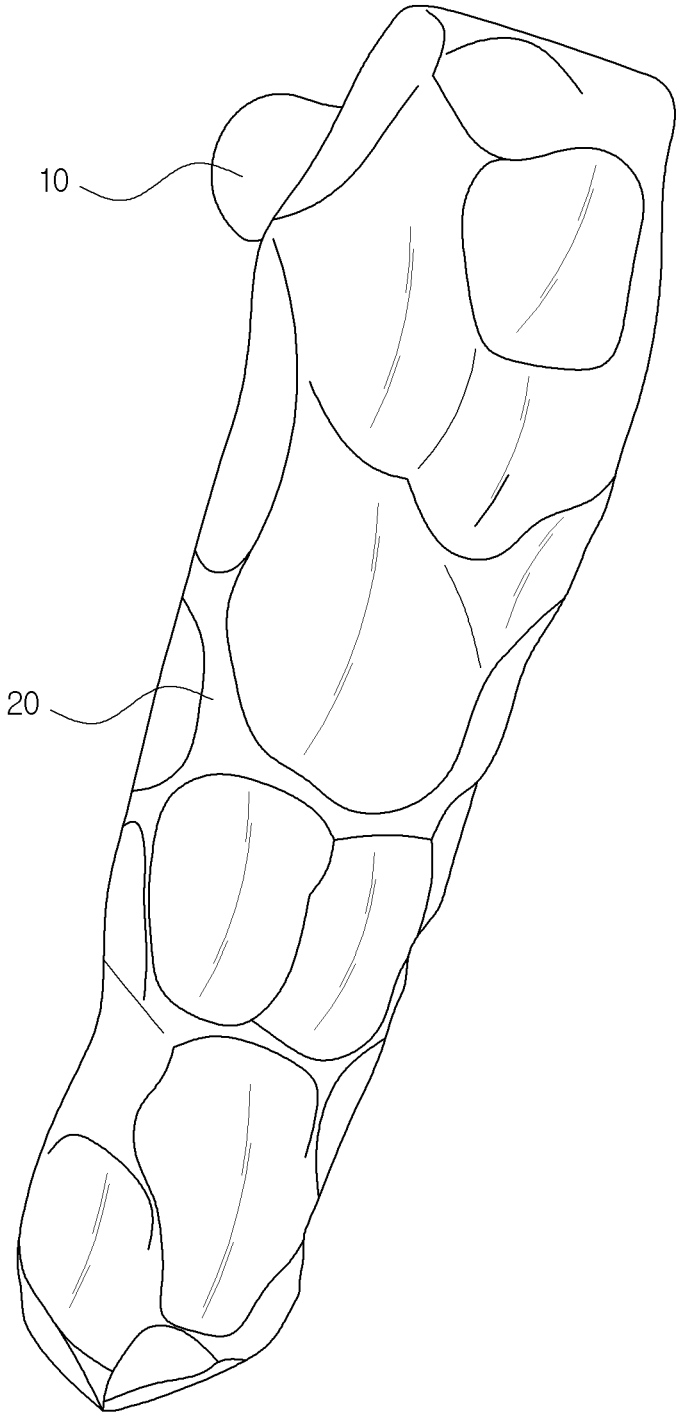
FIG. 6 is a photograph showing a door handle according to preferred embodiments of the present invention.

FIG. 5 is a photograph showing a door handle according to a preferred embodiment of the present invention, and FIG. 6 is a photograph showing a door handle according to a preferred embodiment of the present invention.

As shown in FIGS. 1 to 6, the door handle according to embodiments of the present invention can be coupled to the locking bar 2 provided at the door 1, and the user can conveniently and easily replace or change the door handle as necessary.

When a user wants to couple the door handle with the locking bar 2, the user can freely select the handle body 20 having an appropriate shape and can choose the door handle to be replaced according to the user's preference or taste.

The user can select door handles having various shapes in addition to the door handle shown in FIG. 5 or the door handle shown in FIG. 6. In order to replace or change a door handle with the selected door handle, the user separates the door handle provided in the locking bar 2.

The separation of the door handle is achieved by unfastening the fixing unit 15 coupled to the first connection portion 11 of the connection member 10 using a tool such as a screwdriver and the like. Thus, the door handle is separated from the locking bar 2.

In this manner, the user can change a door handle with the door handle selected for the replacement or change in a state that the door handle is separated from the locking bar 2. The user couples the fixing unit 15 to the first hole 14 in a state that the groove 13 formed in the first connection portion 11 of the connection member 10 is inserted therein with the locking bar 2.

In other words, when the fixing unit 15 is a bolt, the bolt is fastened to the first hole 14 of the first connection portion 11, and the locking bar 2 is pressed to maintain a state that the first connection portion 11 is firmly fixed to the locking bar 2.

In addition, the connection member 10 and the handle body 20 may be integrally coupled with each other by the fixing unit 15 such as a bolt or a fixing pin, and the second connection portion 12 of the connection member 10 may be bonded or attached to the fitting portion 21 of the handle body 20 by using an adhesive or silicone in a state that the second connection portion 12 is fitted into the fitting portion 21.

Meanwhile, FIGS. 5 and 6 show the door handle manufactured according to embodiments of the present invention, and as shown in FIG. 5, the handle body 20 may have different colors while a surface of the handle body 20 has a rough shape.

In addition, referring to FIG. 6, the handle body 20 is illustratively shown in which a surface of the handle body 20 is rough and irregularly formed.

In other words, as shown in FIGS. 5 and 6, the design for the shape and configuration of the handle body 20 can be variously selected suitable for the preference or taste of the user such that the handle body 20 can be variously molded and manufactured.

In addition, if a material is deformable such as wood, plastic, synthetic resin, paper and the like, the user can modify the material into various forms or shapes desired by the user.

Although the present invention provided by the inventor has been described in detail with reference to the embodiments as described above, the present invention is not limited to the embodiments, and various modifications can be made without departing from the spirit of the present invention.

The invention claimed is:

1. A replacement door handle comprising:

a connection member including a first connection portion having a predetermined length and having a groove with a certain depth so as to be coupled to a locking bar of a door lock, and a second connection portion integrally formed with the first connection portion, extending straight from the first connection portion in a crossing direction with respect to a longitudinal direction of the first connection portion, and including a front surface, a back surface, a top surface, a bottom surface, a left side surface disposed on a distal end of the second connection portion from the first connection portion, and a right side surface disposed on a proximal end of the second connection portion from the first connection portion and opposite to the left side surface; and a handle body having a fitting portion having a length equal to a length of the second connection portion, wherein the front, top, bottom, left side and right side surfaces of the second connection portion are configured to be entirely fitted inside the fitting portion of the handle body, and the back surface of the second connection portion is configured to be exposed outside the fitting portion, wherein the connection member includes a first hole formed in the first connection portion for fixing the connection member to the locking bar of the door lock, a fixing unit coupled to the first hole, and a second hole corresponding to a fixing hole of the handle body, and wherein the fixing hole is configured for fixing the handle body onto the connection member.

2. The replacement door handle of claim 1, wherein the handle body is bonded in a state that the handle body is fitted around the second connection portion.

3. The replacement door handle of claim 1, wherein the handle body is coupled by another fixing unit in a state that the handle body is fitted around the second connection portion.

* * * * *